US006155679A

United States Patent [19]

Sato

[11] Patent Number: 6,155,679

[45] Date of Patent: Dec. 5, 2000

[54] AIR-LIQUID SEPARATING CHAMBER AND INK JET PRINTER PROVIDED WITH THE SAME

[75] Inventor: Akira Sato, Shizuoka-ken, Japan

[73] Assignee: Toshiba Tec Kabushiki Kaisha, Tokyo, Japan

[21] Appl. No.: 09/383,567

[22] Filed: Aug. 25, 1999

[30] Foreign Application Priority Data

Aug. 28, 1998 [JP] Japan ..... 10-244083

[51] Int. Cl.[7] ..... B41J 2/19

[52] U.S. Cl. ..... 347/92

[58] Field of Search ..... 347/92, 89, 85, 347/86, 87, 30, 36

[56] References Cited

U.S. PATENT DOCUMENTS

| | | | |
|---|---|---|---|
| 5,329,306 | 7/1994 | Carlotta | 347/90 |
| 5,341,162 | 8/1994 | Hermanson et al. | 347/92 |
| 5,363,130 | 11/1994 | Cowger et al. | 347/92 |
| 6,059,405 | 5/2000 | Mochizuki et al. | 347/92 |

FOREIGN PATENT DOCUMENTS

| | | |
|---|---|---|
| 6-171108 | 6/1994 | Japan . |
| 10-138520 | 5/1998 | Japan . |

*Primary Examiner*—N. Le
*Assistant Examiner*—Michael Nguyen
*Attorney, Agent, or Firm*—Frishauf, Holtz, Goodman, Langer & Chick, P.C.

[57] ABSTRACT

A separation promoting member comprises container having the bottom surface, an introduction side cylinder having slits or small holes and a discharge side cylinder having slits or small holes. The introduction side cylinder has the upper part communicated with an air-liquid introducing inlet port provided on the container and the lower part separated from the bottom surface with a gap. The discharge side cylinder has a upper part communicated with a gas discharging outlet port provided on the container, and the lower part separated from the bottom surface with a gap. In the container, partition walls for defining the path of a gas or an air-liquid mixture are arranged between the cylinders. The partition walls are fixed to the container with the lower end thereof separated from the bottom surface. A liquid discharging outlet port is provided on the lower surface of the container.

8 Claims, 7 Drawing Sheets

AIR-LIQUID SEPARATING CHAMBER AND INK JET PRINTER PROVIDED WITH THE SAME

BACKGROUND OF THE INVENTION

The present invention relates to an air-liquid separating chamber for separating a liquid containing bubbles into air and liquid, and an ink jet printer provided with the same, in particular, relates to an air-liquid separating chamber for introducing an air-liquid mixture, such as a waste ink from an air-liquid introducing inlet port on the upper surface side into a main body accommodating a member for promoting separation so as to be separated into liquid and air, discharging the separated air to the outside from a gas discharging outlet port on the upper surface side, and discharging the separated liquid to the outside from a liquid discharging outlet port on the lower surface side, and an ink jet printer provided with the same.

Air-liquid separating chambers for separating an air-liquid mixture into liquid and gas are used in various technical fields. Naturally, as to the performance of the air-liquid separating chamber, an air-liquid separating chamber having a high separation property (separation efficiency), capable of providing a liquid after separation without a gas, that is, bubbles remained (mixed) and a gas after separation without a liquid remained (mixed) is regarded to be preferable.

For example, in an ink jet printer (for example, Jpn. Pat. Appln. KOKAI Publication No. 10-138520) comprising a large number (for example, 1,000 pieces) of ink jet nozzles arranged in the main scanning direction (a direction of width of a paper sheet), capable of printing one line simultaneously on the paper sheet by driving all the ink jet nozzles at the same time, and as a result, capable of printing 600 or more paper sheets at 20 PPM with a high image quality with colors continuously, maintenance for preventing choking of each ink jet nozzle is important. According to the trend toward the high performance of the ink jet printer, it is required to treat the waste ink discharged from each ink jet nozzle certainly, and achievement of efficiency in separating into a gas and a liquid is required.

FIG. 1 is a schematic block diagram showing an ink jet nozzle head of an ink jet printer having an air-liquid separating chamber and a maintenance part for preventing choking of the ink jet nozzle. In FIG. 1, a nozzle head 10 for one color is illustrated. The nozzle head 10 has an ink room 11, with the ink room 11 communicating with an ink jet nozzle 12. At the time of maintenance, each ink jet nozzle 12 is faced to an ink receiving member 21 so that an ink is forcibly pressed in this state so as to be supplied into the ink room 11 and the ink (liquid) discharged from each ink jet nozzle 12 is received by an ink receptacle 22. Thereafter, the ink receptacles 22, 21 are detached from the nozzle heads 10, 12 so that the surfaces of the nozzle heads 10, 12 and the ink receiving member 21 can be cleaned by a blade 27B mounted on a slide 27 to be reciprocated on a rod 27R.

Here, if an air discharging pump 25 comprising means 20 for discharging a waste ink is driven for applying a negative pressure in an air-liquid separating chamber 30P, the bubble-like waste ink stored in the ink receptacle 22 via a discharging pipe 23 is vacuumed into the air-liquid separating chamber 30P so as to be separated into a gas and a liquid. The separated liquid (waste ink) is collected in a waste ink bottle 26 according to the drive of a waste ink discharging pump 24 provided in the discharging pipe 23. Therefore, the liquid (waste ink) can be collected without scattering the waste ink or fouling the surroundings.

As shown in FIG. 2A, the conventional air-liquid separating chamber 30P comprises an upper lid (upper structure) 32P having a separation promoting member 40P comprising an air-liquid introducing inlet 33, a gas discharging outlet 37 and a baffle plate for prohibiting the flow of a bubble-like waste ink. The upper lid 32P is mounted on a main body 31P shown in FIG. 2B for providing the air-liquid separating chamber 30P as shown in FIGS. 2C, 3 and 4, with a configuration wherein the inside of the main body 31P is separated in two by the baffle plate.

The air-liquid mixture Qia discharged from the air-liquid discharging outlet 33 enters the left room shown in FIG. 3 so as to flow downward. It is separated into the gas and the liquid at the lower end part of the baffle plate 40P. The separated gas (air) flows upward toward an air-liquid discharging outlet port 37 as well as the heavy ink Qi is discharged from an ink discharging outlet port 35.

In order to provide the above-mentioned configuration in the conventional air-liquid separating chamber 30P, the main body 31P and the baffle plate (40P) need to be increased in height. However, similar to the case of other devices, the above-mentioned ink jet printer is strongly required to have a smaller size, and thus there is a limitation in increasing in height. Besides, in order to achieve a higher image quality printing, it is intolerable to have a slight amount of an ink mixed in a gas discharged to the outside as well as scattering of the ink.

These problems are not limited to the above-mentioned ink jet printer, but similar problems are involved in the other devices, which require collection of an air-liquid mixture. Moreover, in some applications, a gas remained in a collected liquid can never be allowed. In this case, achievement of a small size while improving the separation efficiency is required.

BRIEF SUMMARY OF THE INVENTION

A first object of the present invention is to provide an air-liquid separating chamber for separating an air-liquid mixture into air and liquid with a high air-liquid separation efficiency and a small size.

Moreover, a second object of the present invention is to provide an ink jet printer capable of executing a maintenance work of an ink jet nozzle smoothly.

According to the invention, an air-liquid separating chamber for introducing an air-liquid mixture into a main body accommodating a separation promoting member from an air-liquid introducing inlet port on the upper surface side for separating the same into liquid and air so that the separated air can be discharged to the outside from an air discharging outlet port on the upper surface side and the liquid can be discharged to the outside from a liquid discharging outlet port on the lower surface side, wherein the separation promoting member comprises an introduction side cylinder having a large number of slits or holes, with the upper part communicated with the air-liquid introducing inlet port and the lower part separated from the bottom surface side of the main body with a gap, and a discharge side cylinder having a large number of slits or holes, with the upper part communicated with the gas discharging outlet port and the lower part separated from the bottom surface side with a gap, can be provided.

According to the invention, the air-liquid mixture introduced from the air-liquid introducing inlet port on the upper surface side of the main body so as to enter the introduction side cylinder as the separation promoting member has the liquid component thereof clash with the inner periphery surface of the introduction side cylinder so as to drop downward while sticking as well as the gas component flows toward the gas discharging outlet through the slits or the holes. That is, air-liquid separation can be promoted.

Furthermore, the liquid after separation flows on the lower surface so as to be discharged to the outside from the liquid discharging outlet port. The gas after separation enters the discharge side cylinder through the narrow slits or holes while flowing on the outer periphery surface of the discharge side cylinder. The vapor-like liquid remained (mixed) in the gas clashes with the outer periphery surface so as to be stuck and separated while flowing along the outer periphery surface, and dropped to the lower surface side. Moreover, air-liquid separation similar to the air-liquid separation in the introduction side cylinder is executed in the discharge side cylinder. The gas after separation is discharged to the outside from the gas discharging outlet port on the upper surface side.

Therefore, since air-liquid separation function can be pursued inside and outside the cylinders, air-liquid separation can be executed with a high efficiency as well as a simple configuration and a small size can be achieved.

Moreover, according to the invention, an air-liquid separating chamber, wherein the slits of the introduction side cylinder are provided in the direction behind the discharge side cylinder, and the slits of the discharge side cylinder are provided in the direction behind the introduction side cylinder, can be provided.

According to the invention, since the gas containing the residual liquid, applied with air-gas separation in the introduction side cylinder flows through the slits provided in the direction behind the introduction side cylinder, the air-liquid separation function in the introduction side cylinder can further be promoted. Moreover, since the gas containing a slight amount of the residual liquid flows into the discharge side cylinder through the slits in the direction behind the introduction side cylinder, the air-liquid separation function in the introduction side cylinder can further be promoted. Accordingly, the advantage the same as the case of the first aspect of the invention can be achieved, and furthermore, since the flowing path can be longer and the chance of the clash in the cylinders can be increased, the air-liquid separation can be executed with a further high efficiency.

Moreover, a third aspect of the invention is an air-liquid separating chamber, comprising a plurality of partition members so arranged between the introduction side cylinder and the discharge side cylinder as to form a maze path and has a upper part fixed to the upper surface and a lower part separated from the bottom surface with a gap.

According to the invention, the gas or air containing the remained liquid discharged from the slits of the introduction side cylinder flows to the discharge side cylinder slit side through the maze path formed with the partition members. Therefore, the advantage the same as the cases of the first aspect and the second aspect of the invention can be achieved, and furthermore, since the air-liquid separation function can further be promoted in the maze, the air-liquid separation can be executed further completely.

Moreover, a fourth aspect of the invention is an air-liquid separating chamber, wherein the lower surface of the main body is inclined downward toward the liquid discharging outlet port.

According to the invention, the liquid separated by the cylinders and the partition members so as to be dropped flows on the bottom surface inclined downward toward the liquid discharging outlet port and discharged to the outside from the liquid discharging outlet port.

Therefore, the advantage the same as the cases of the first to third aspects of the invention can be achieved, and furthermore, the liquid after separation can be discharged smoothly and completely, re-scattering of the liquid can be prevented. That is, the air-liquid separation can be executed further efficiently.

Furthermore, a fifth aspect of the invention is an air-liquid separating chamber, wherein the discharge side bottom surface facing to the discharge side cylinder is disposed at a position higher than the introduction side bottom surface facing to the introduction side cylinder, and the discharge side bottom surface is inclined downward toward the introduction side bottom surface.

According to the invention, the liquid after separation dropped onto the discharge side bottom surface facing to the discharge side cylinder flows toward the introduction side bottom surface, and further flows on the introduction side bottom surface toward the liquid discharging outlet port. That is, the liquid separated in the discharge side cylinder can be kept away from the discharge side cylinder, that is, the gas discharging outlet side quickly. Therefore, the advantage the same as the case of the fourth aspect of the invention can be achieved, and furthermore, the liquid contained in the gas discharged from the gas discharging outlet can be eliminated completely.

Moreover, a sixth aspect of the invention is an ink jet printer comprising the air-liquid separating chamber according to any one of the first to fifth aspects, capable of collecting a waste ink separated from the air-liquid mixture discharged from an ink jet nozzle.

According to the invention, the air-liquid mixture discharged from the ink jet nozzle is applied with the air-liquid separation in the discharge side cylinder so that the waste ink after separation is discharged from the liquid discharging part so as to be collected, for example, in a waste ink tank. Therefore, maintenance of the ink jet nozzle can be executed smoothly as well as since the waste ink cannot be scattered to the surroundings, leakage of the ink onto a paper sheet, or the like, can be prevented.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 10 is an external appearance perspective view showing the entire configuration of the air-liquid separating chamber shown in FIG. 5, with a part thereof seen through.

FIG. 11 is an external appearance perspective view showing the entire configuration of an air-liquid separating chamber according to a modified embodiment of the present invention, with a part thereof seen through.

DETAILED DESCRIPTION OF THE INVENTION

Hereinafter, embodiments of air-liquid separating chambers of the present invention will be explained with reference to the accompanied drawings.

Figure 6:
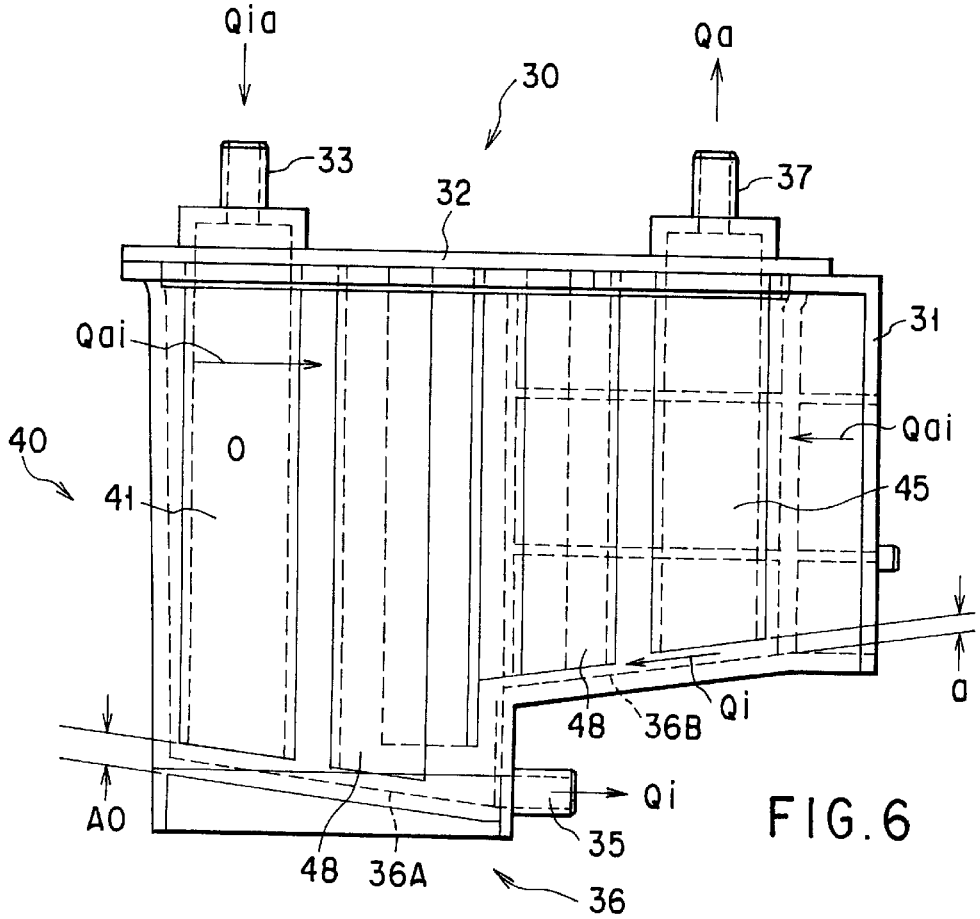
FIG. 6 is a side view schematically showing the air-liquid separating chamber shown in FIG. 5.

As shown in FIGS. 5 to 10, an air-liquid separating chamber 30 comprises a separation promoting structure 40 for separating an air-liquid mixture, that is, a bubble-like waste ink into air and liquid. In the separation promoting structure 40, an air-liquid introducing inlet port 33 for introducing an air-liquid mixture is provided in the upper part thereof. As shown in FIG. 6, the air-liquid introducing inlet port 33 is communicated with an introduction side cylinder 41. The introduction side cylinder 41 is elongated from the air-liquid introducing inlet port 33 toward a bottom surface 36, with the lower part thereof disposed with a distance A0 from the bottom surface 36 and with the side surface thereof provided with slits 42.

Moreover, the separation promoting structure 40 is provided with a gas discharging outlet port 37 in the upper part thereof for discharging a separated gas or air. As shown in FIG. 6, the gas discharging outlet port 37 is communicated with a discharge side cylinder 45 similarly. The discharge side cylinder 45 is elongated from the gas discharging outlet port 37 toward the bottom surface 36, with the lower part thereof disposed with a distance A0 from the bottom surface 36, and with the side surface thereof provided with slits 46. The distance A0 is set to be 2 mm.

In this embodiment, the case the air-liquid separating chamber 30 comprises a part of the waste ink discharging means 20 of the ink jet printer explained with reference to FIG. 1 will be explained hereinafter. FIGS. 5 to 10 show a configuration capable of treating four colors of waste inks simultaneously. Since the treatment of the waste ink of each color is independent and the structure of the chamber 30 is the same, explanation will be given only for one color in the following detailed description, but the structure for treating the other colors is not explained herein.

Figure 7:
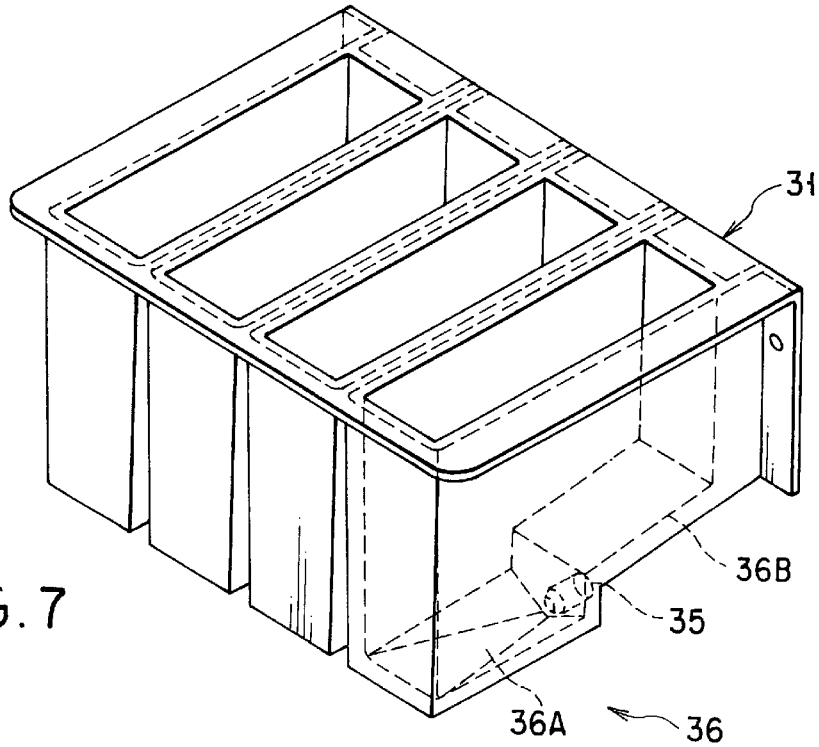
FIG. 7 is an external appearance perspective view for explaining the main body of the air-liquid separating chamber shown in FIG. 5.

As shown in FIG. 7, a main body 31 is sectioned into four chambers. Each chamber is formed with a box-like shape with the upper part thereof opened, having a bottom plate 36 for defining the bottom surface and side walls for defining the four side surfaces. The bottom plate 36 of the chamber has the surfaces 36A and 36B inclined downward toward a liquid discharging outlet port 35 for discharging a liquid. There is provide a step between the surfaces 36A and 36B and the liquid discharging outlet port 35 for discharging a waste liquid to the outside is opened in the step and is disposed in the lowermost region of the surface 36A. Among the bottom surface 36 shown in FIG. 6, an introduction side bottom surface 36A facing to the introduction side cylinder 41 is set at a level lower than that of a discharge side lower surface 36B facing to the discharge side cylinder 45, with the discharge side lower surface 36B inclined downward toward the introduction side lower surface 36A, and the liquid discharging outlet port 35 provided at the inclined end of the introduction side lower surface 36A.

Figure 8:
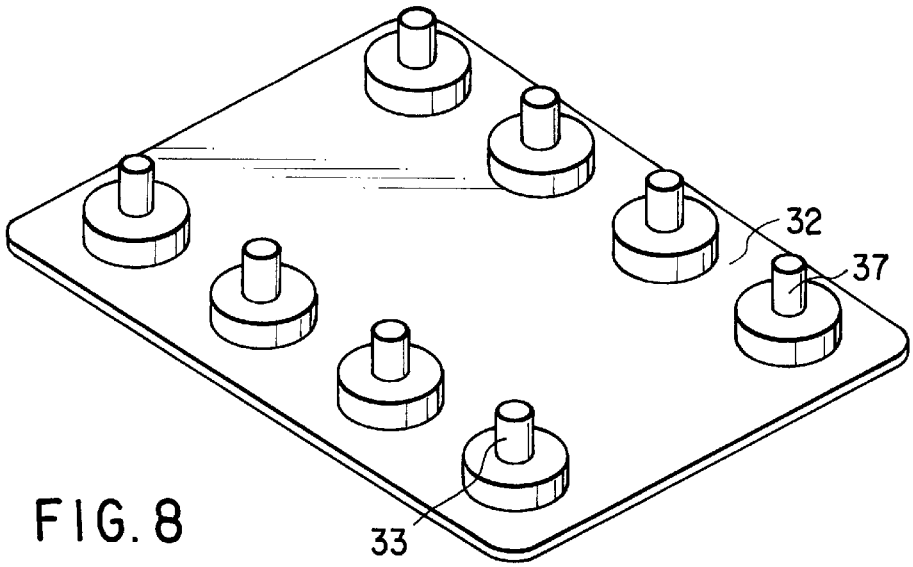
FIG. 8 is a perspective view showing the external appearance of the upper lid comprising a part of the main body of the air-liquid separating chamber shown in FIG. 5.

As shown in FIG. 8, air-liquid introducing inlet port 33 and gas discharging outlet port 37 are provided in an upper lid 32. Moreover, in order to facilitate processing and assembly, separation promoting structures 40 are mounted on the upper lid 32 in this embodiment as shown in FIG. 9.

Figure 9:
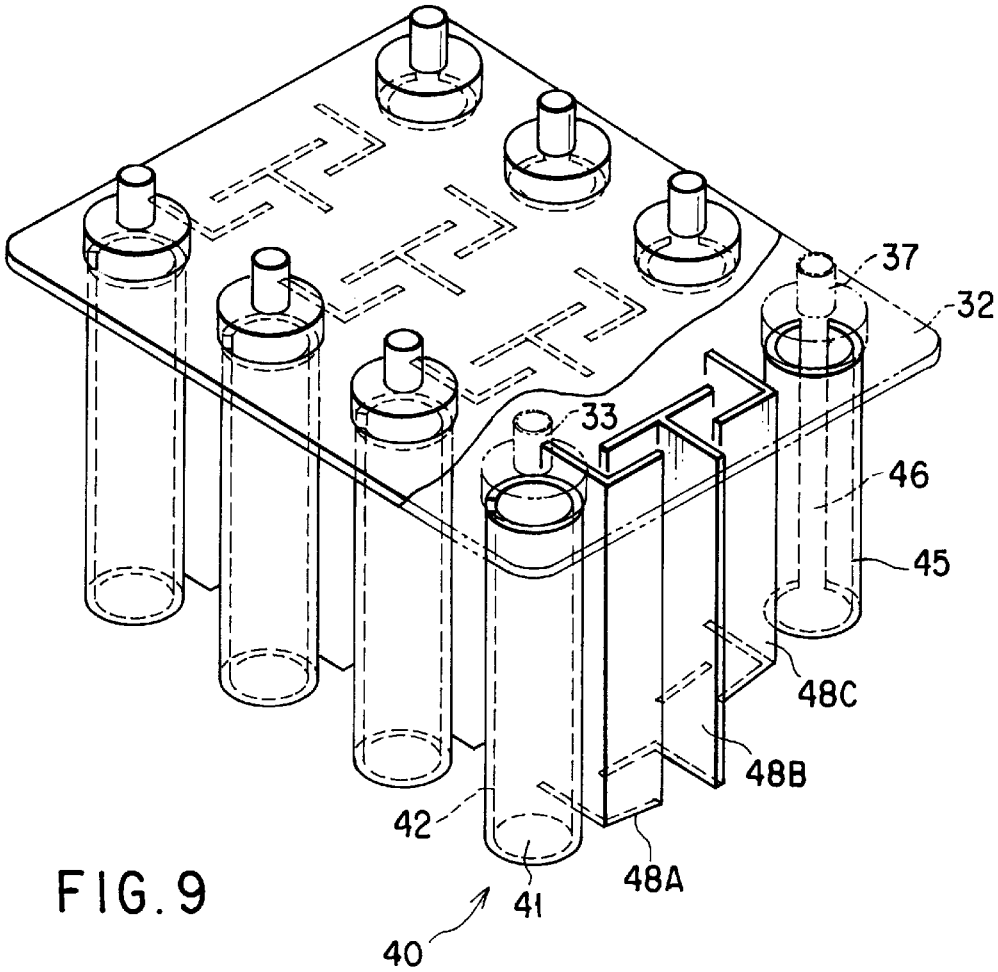
FIG. 9 is an external appearance perspective view for explaining the state with the upper lid of the air-liquid separating chamber shown in FIG. 5 mounted with the separation promoting member.
Figure 10:
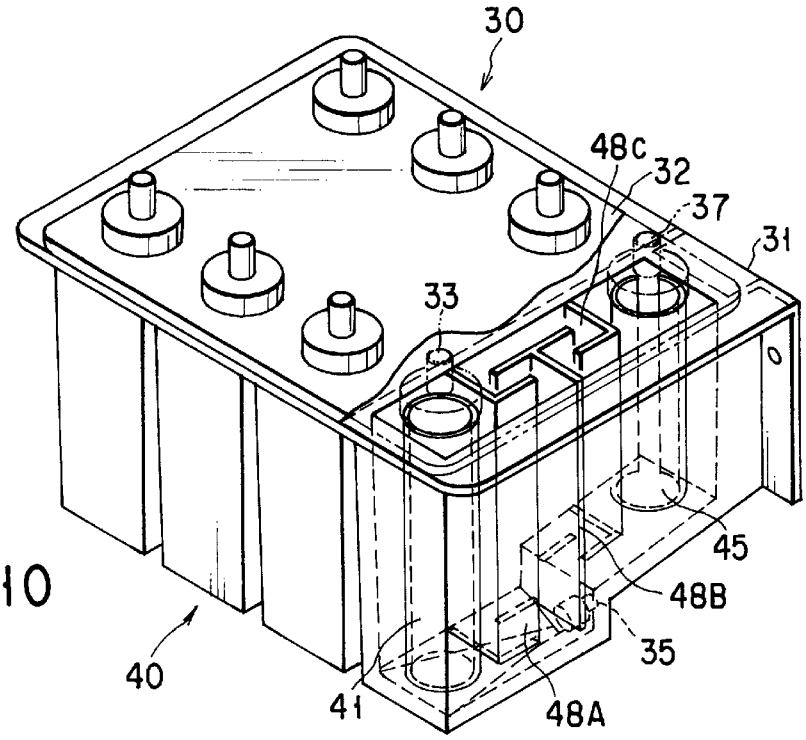

As shown in FIGS. 9 and 10, each separation promoting structure 40 comprises the introduction side cylinder 41 and the discharge side cylinder 45, and two partition walls 48A and 48C having an L-shaped cross-section and a partition wall 48B having a T-shaped cross-section 48A, 48B and 48C for defining the maze path therebetween. More specifically, one wall surface of one of the L-shaped cross-section partition wall 48A is disposed facing to the introduction side cylinder 41. One wall surface of the other L-shaped cross-section partition wall 48C is disposed facing to the discharge side cylinder 45. Further, the T-shaped cross-section partition wall 48B having three wall surfaces is disposed between the pair of the L-shaped cross-section partition walls 48, with the two continuous wall surfaces of the T-shaped cross-section partition wall 48B disposed each facing to the other wall surface of the two L-shaped cross-section partition walls 48A, 48C, and one wall surface orthogonal to the two wall surfaces of the T-shaped cross-section partition wall 48B disposed so as to section the space between the other wall surfaces of the two L-shaped cross-section partition walls 48A, 48C.

The slits 42 of the introduction side cylinder 41 and the slits 46 of the discharge side cylinder 45 are arranged such that the slits 42 formed in the introduction side cylinder 41 and the slits 46 formed in the discharge side cylinder 45 do not face with each other, in other words, a gas Qia discharged from the slits 42 of the introduction side cylinder 41 reaches to the slits 46 of the discharge side cylinder 45 in such a manner that it travels along the longest moving path. In respect to the size of the slits 42 and 46 formed in the cylinders 41, 45, if the slit 42, 46 has a relatively large size in comparison with the size of bubble in the air-liquid mixture, the flow rate of the air-liquid mixture or bubbles is decreased so that the air-liquid separation function of separating the mixture into the air and liquid in the cylinders 41, 45 is deteriorated. However, if the slit 42, 46 has a relatively small size in comparison with the bubble in the air-liquid mixture, a relatively large load or power is applied to pumps for discharging the air or gas and the liquid so that there is a problem that the pumps may have a trouble or brake down. Thus, in consideration of the above problems, the slit width or size of the slits 42 and the slits 46 is selected in the range from 1.5 to 3.5 mm, and more preferably selected in the range from 1.8 to 2.2 mm.

Here, in order to increase the chance that a liquid containing bubbles introduced into the introduction side cylinder 41 is separated into the gas or air and the liquid at the time of passing through the slits 42 and the liquid passed through the slits 42 still containing the bubbles clashes with the wall surface of the side wall and the partition walls 48 so as to be separated into the gas and the liquid, it is preferable that it reaches at the slits 46 of the discharge side cylinder 45 after passing through the longest moving path so that the gas and the liquid are separated securely also by the slits 46 for introducing only the gas or air into the discharge side cylinder 45. It is preferable to prevent the bubble-like liquid (ink) discharged from the slits 42 of the introduction side cylinder 41 from flowing into the slits 46 of the discharge side cylinder 45 by the shortest distance as much as possible.

As mentioned above, the partition wall members 48 having the L-shaped cross-section and the T-shaped cross-section are assembled and arranged such that the gas Qia discharged from the slits 42 of the introduction side cylinder 41 reaches the slits 46 of the discharge side cylinder 45 after passing through the longest moving path. The partition wall members 48A, 48B and 48C have the upper part thereof fixed to the upper surface 32 between the introduction side cylinder 41 and the discharge side cylinder 45, and the lower part thereof disposed separated from the lower surface 36 by the distance a as shown in FIGS. 6 and 10.

Figure 1:
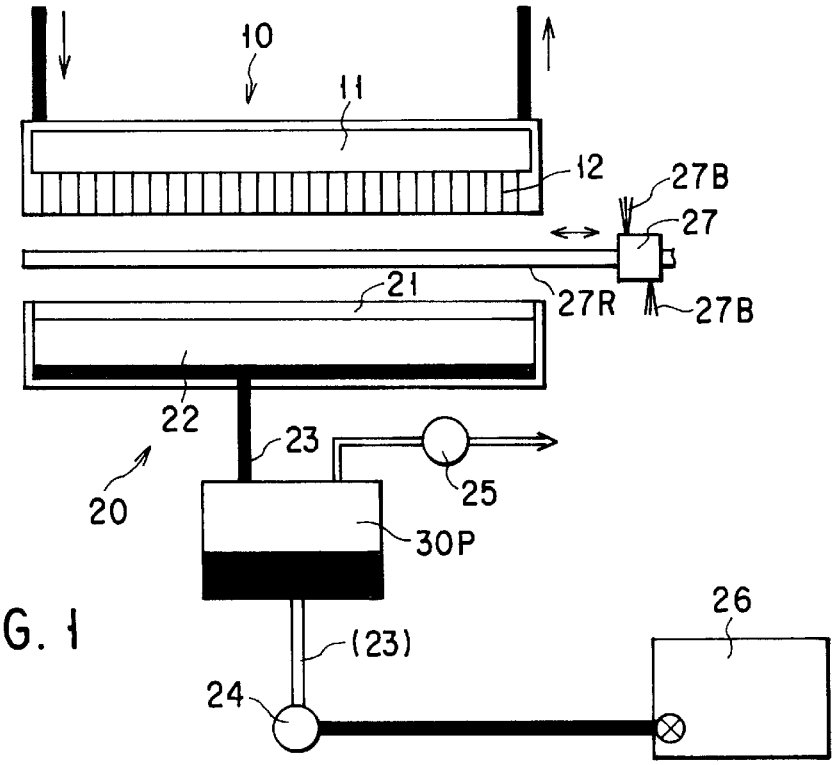
FIG. 1 is a block diagram schematically showing the configuration of a nozzle head and the peripheral devices thereof in an ink jet printer.
Figure 2A:
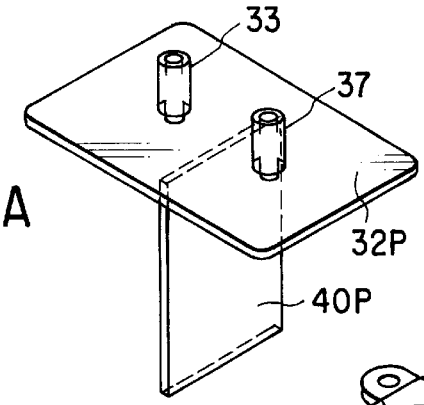
FIGS. 2A to 2C are exploded perspective views schematically showing the configuration of a conventional air-liquid separating chamber.
Figure 2B:
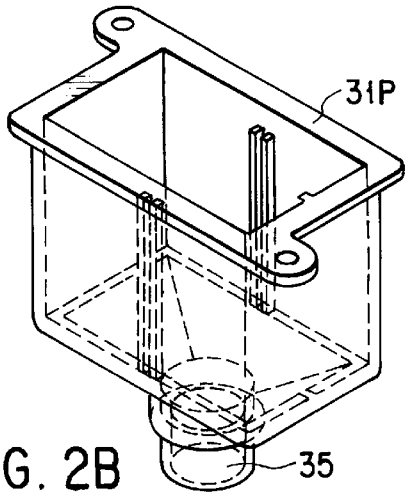
Figure 2C:
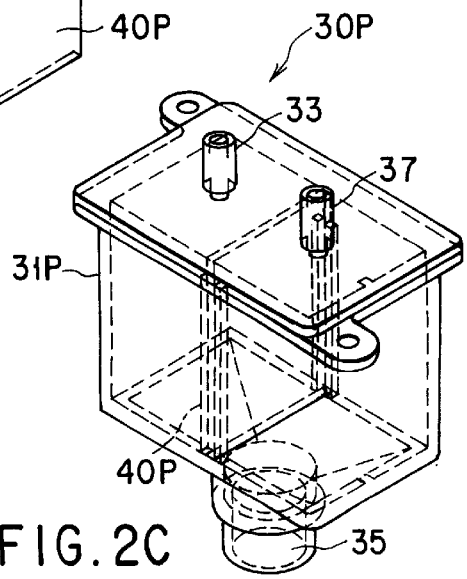
Figure 3:
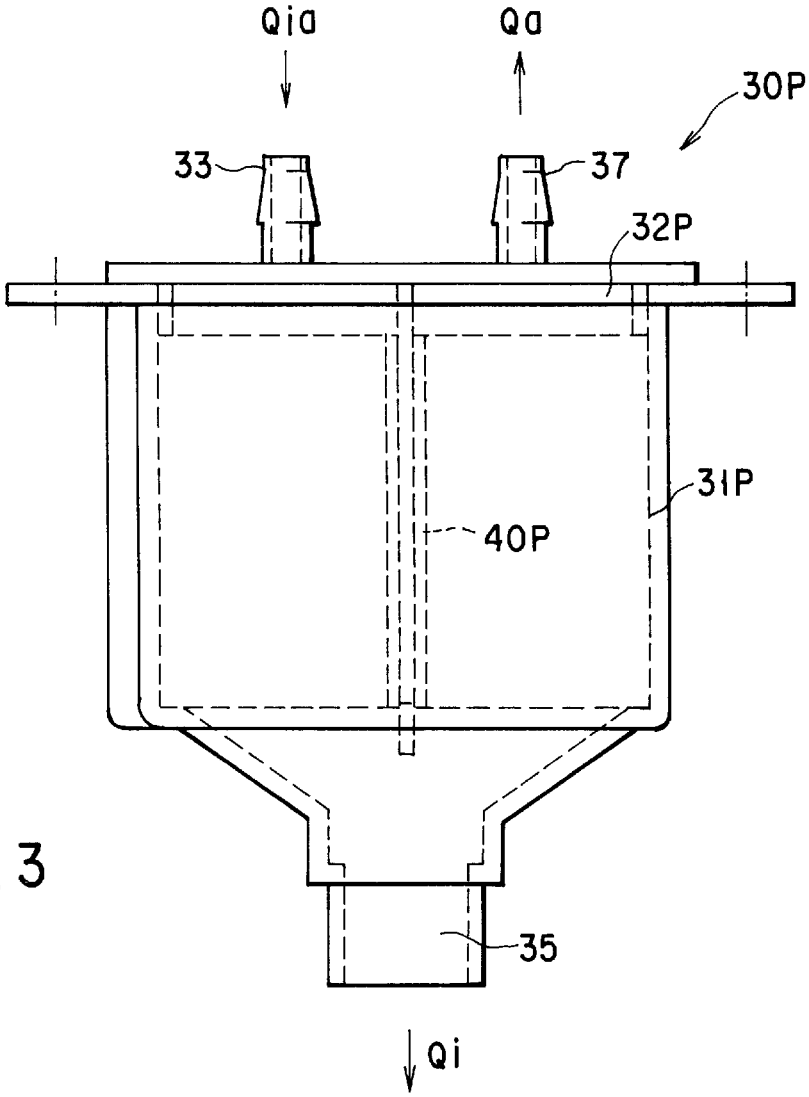
FIG. 3 is a side view schematically showing the conventional air-liquid separating chamber shown in FIGS. 2A to 2C.
Figure 4:
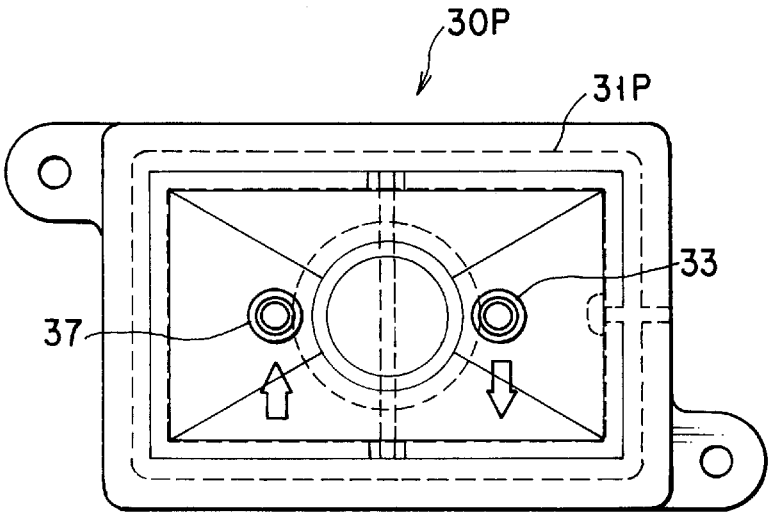
FIG. 4 is a plan view schematically showing the conventional air-liquid separating chamber shown in FIGS. 2A to 2C.
Figure 5:
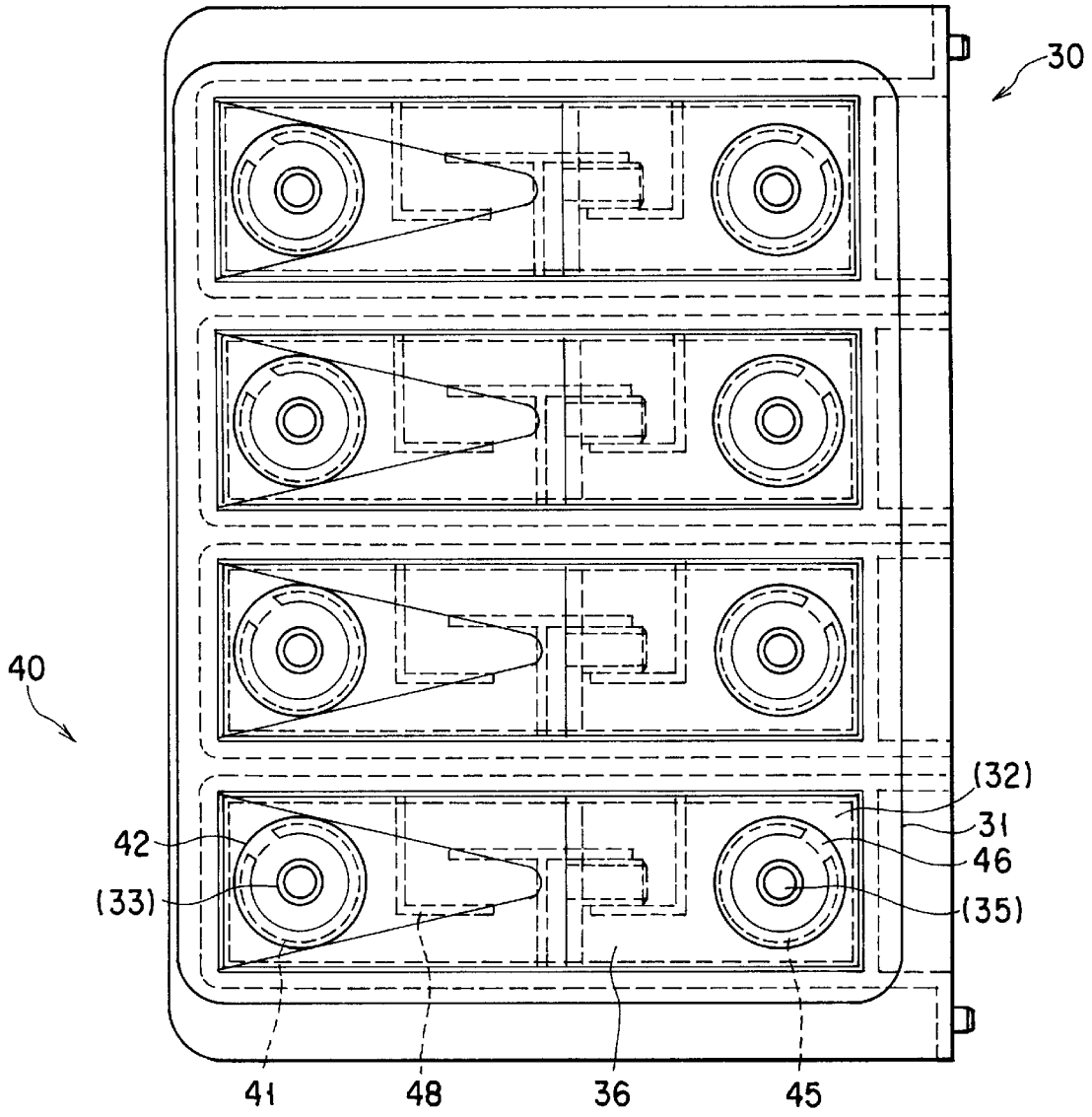
FIG. 5 is a plan view schematically showing an air-liquid separating chamber according to an embodiment of the present invention.

In the air-liquid separating chamber 30 of the above-mentioned embodiment, if the air discharging pump 25 shown in FIG. 1 is driven, a negative pressure is generated in the main body 31 so that the waste ink stored in the ink receptacle 22 is introduced to the air-liquid separation promoting structure 40 shown in FIGS. 6 and 10.

That is, the bubble-like waste ink is introduced from the air-liquid introducing inlet port 33 on the upper surface 32 side of the main body 31, and the bubble-like air-liquid mixture Qia introduced into the introduction side cylinder 41 constituting the separation promoting structure 40 has the liquid Qi component thereof clash with the inner periphery surface of the introduction side cylinder 41 so as to drop downward while sticking as well as the gas or air Qai component is discharged through the slits 42 toward the slits 46 of the discharge side cylinder 45. That is, in the process toward the slits 46 of the discharge side cylinder 45, the air-liquid mixture Qia, which has passed the slits 42, clashes with the wall surface in the moving path thereof so that air-liquid separation can be promoted. The liquid Qi after separation flows on the lower surface 36A so as to be discharged from the liquid discharging outlet port 35 to a waste ink bottle 26 outside the structure 40.

As explained above, the gas or bubble Qai having the liquid discharged from the slits 42 still remaining flows to the slits 46 of the discharge side cylinder 45 through the maze path formed with the partition wall members 48. Therefore, also in the maze path 48, the air-liquid separation function is promoted, and thus air-liquid separation can be realized further completely.

Furthermore, the gas Qai after separation is introduced into the discharge side cylinder 45 through the narrow slits 46 while flowing along the outer periphery surface of the discharge side cylinder 45. The bubble-like liquid Qi remained in the gas Qa clashes with the outer periphery surface 45 while flowing along the outer periphery surface so as to be separated and dropped downward to the lower surface 36B side while sticking. Moreover, in the discharge side cylinder 45, air-liquid separation similar to the air-liquid separation in the introduction side cylinder 41 is executed so that the separated gas Qa is discharged from the gas discharging outlet 37 on the upper surface 32 side to the outside.

As mentioned above, since the moving path can be provided longer, and the chance of clashing in the cylinders 41, 45 can be increased, as well as the air-liquid separation function can be realized inside and outside the cylinders 41, 45, highly efficient air-liquid separation can be enabled with a simple configuration and a small size so that a smaller size can be realized in a device, such as an ink jet printer, if a chamber of the present invention is assembled in the device.

Furthermore, since the liquid (ink) Qi separated and dropped by the cylinders 41, 45 and the partition wall members 48A, 48B and 48C flows on the lower surfaces 36A, 36B inclined downward toward the liquid discharging outlet 35, and is discharged to the outside from the liquid discharging outlet 35, the liquid after separation can be discharged smoothly and completely. That is, re-scattering of the liquid Qai can be prevented.

Besides, the liquid Qi after separation, dropped onto the discharge side lower surface 36B facing to the discharge side cylinder 41 flows on the introduction side lower surface 36A toward the liquid discharging outlet port 35. That is, the liquid Qi separated by the discharge side cylinder 41 can be kept away from the discharge side cylinder 45, that is, from the air discharging outlet port 37 side quickly.

The air-liquid mixture Qia discharged from the ink jet nozzle 12 is applied with air-liquid separation in the air-liquid separating chamber 30 so that the waste ink Qi after separation can be discharged from the liquid discharging outlet 35 so as to be collected in the waste ink tank 26. Therefore, since the waste ink Qi and Qai does not scatter to the surroundings, fouling of the paper sheet, or the like, with the ink can be prevented.

Figure 11:
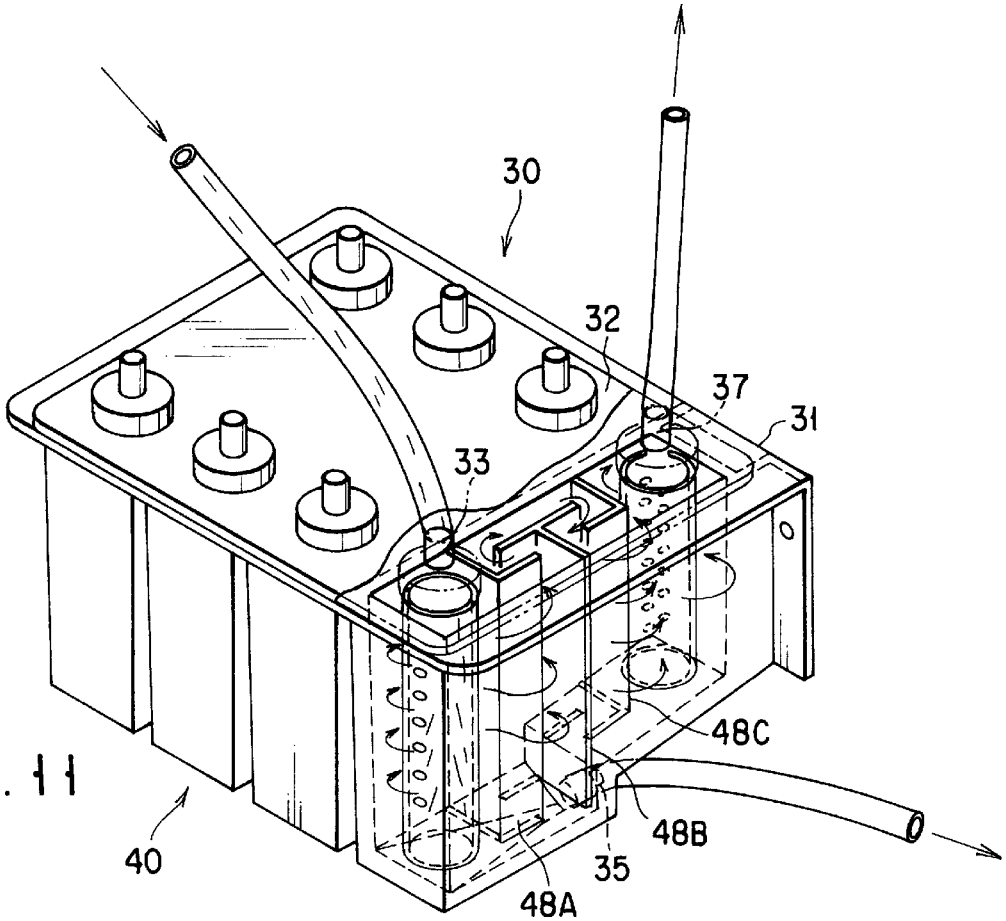
Figure 12:
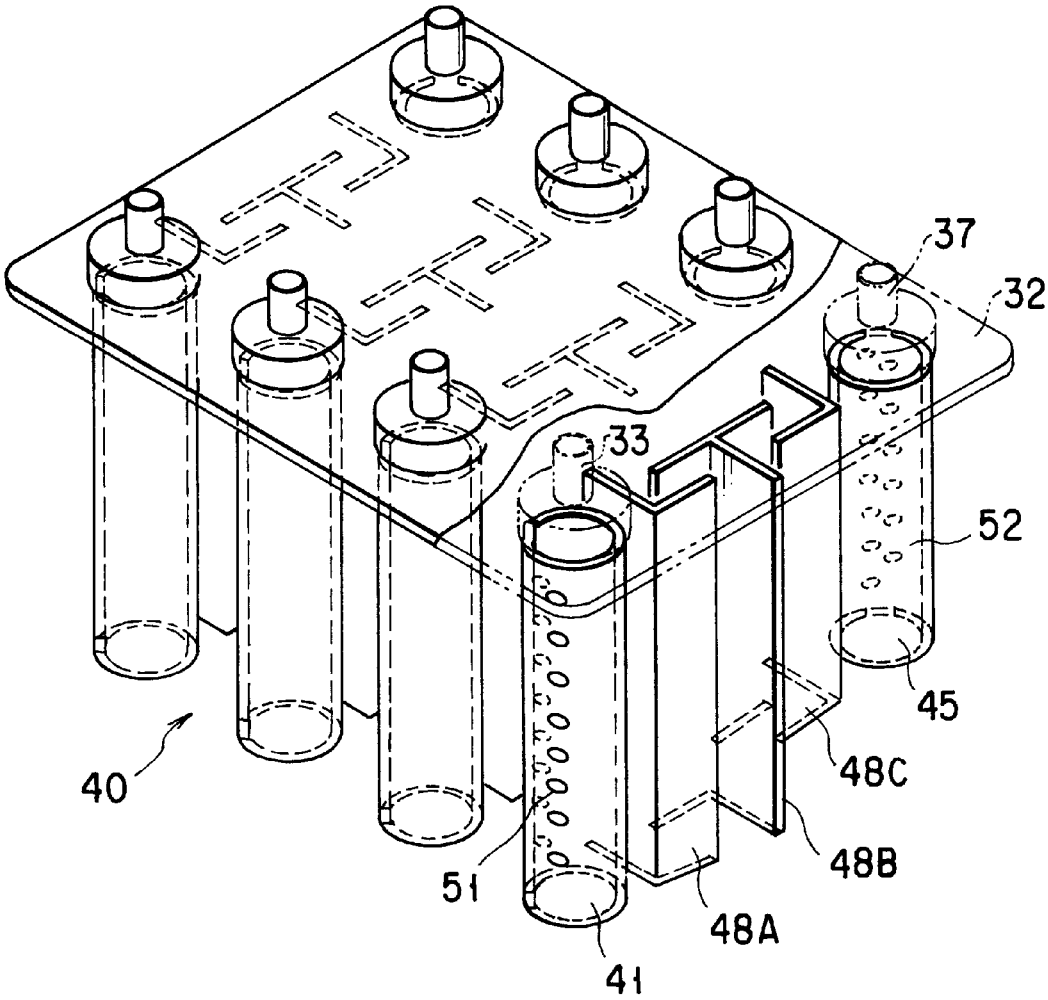
FIG. 12 is an external appearance perspective view for explaining the state with the upper lid of the air-liquid separating chamber shown in FIG. 11 mounted with the separation promoting member.

With reference to FIGS. 11 and 12, a modified embodiment of the present invention will be explained. In the following explanation, parts in FIGS. 11 and 12 applied with the same numerals as in FIGS. 1 to 10 refer to the same parts and explanation is not given below.

Similar to the structure 40 shown in FIGS. 9 and 10, the separation promoting structure 40 shown in FIGS. 11 and 12 comprises the introduction side cylinder 41 and the discharge side cylinder 45, and two partition walls having an L-shaped cross-section and a partition wall having a T-shaped cross-section 48A, 48B and 48C for defining a maze path therebetween. One wall surface of one of the L-shaped cross-section partition wall 48A is disposed facing to the introduction side cylinder 41. One wall surface of the other L-shaped cross-section partition wall 48C is disposed facing to the discharge side cylinder 45. Further, the T-shaped cross-section partition wall 48B having three wall surfaces is disposed between the pair of the L-shaped cross-section partition walls 48, with the two continuous wall surfaces of the T-shaped cross-section partition wall 48 disposed each facing to the other wall surface of the two L-shaped cross-section partition walls 48, and one wall surface orthogonal to the two wall surfaces of the T-shaped cross-section partition wall 48 disposed so as to section the space between the other wall surfaces of the two L-shaped cross-section partition walls 48.

A large number of circular holes 51 formed in the introduction side cylinder 41 in place of the slits 42, and a large number of circular holes 52 formed in the discharge side cylinder 45 in place of the slits 46 are arranged such that the holes 51 in the introduction side cylinder 41 and the holes 52 formed in the discharge side cylinder 45 do not face with each other, in other words, a gas Qia discharged from the holes 51 of the introduction side cylinder 41 reaches the holes 52 of the discharge side cylinder 45 after passing along the longest moving path. In respect to the size of the holes 51 and 51 formed in the cylinders 41, 45, if the holes 51 and 51 has a relatively large size in comparison with the size of bubble in the air-liquid mixture, the flow rate of the air-liquid mixture or bubbles is decreased so that the air-liquid separation function of separating the mixture into the air and liquid in the cylinders 41, 45 is deteriorated. However, if the holes 51 and 51 has a relatively small size in comparison with the bubble in the air-liquid mixture, a relatively large load or power is applied to pumps for discharging the air or gas and the liquid so that there is a problem that the pumps may have a trouble or brake down. Thus, in consideration of the above problems, the slit width or size of the slits 42 and the slits 46 is selected in the range from 1.5 to 3.5 mm, and more preferably selected in the range from 1.8 to 2.2 mm.

Here, in order to increase the chance that a liquid containing bubbles introduced into the introduction side cylinder 41 is separated into gas or air and liquid or ink at the time of passing through the holes 51 and the liquid passed through the holes 51 still containing the bubbles clashes with the wall surface of the side wall and the partition walls 48 so as to be separated into a gas and a liquid, it is preferable that it reaches at the holes 52 of the discharge side cylinder 45 after passing through a long moving path so that the gas and the liquid are separated securely also by the holes 52 for introducing only the gas into the discharge side cylinder 45. It is preferable to prevent the bubble-like liquid or ink discharged from the holes 51 of the introduction side cylinder 41 from flowing into the holes 52 of the discharge side cylinder 45 by the shortest distance as much as possible.

As mentioned above, the partition wall members 48A, 48B and 48C having the L-shaped cross-section and the T-shaped cross-section are assembled and arranged such that the gas Qia discharged from the holes 51 of the introduction side cylinder 41 reaches the holes 52 of the discharge side cylinder 45 after passing through the longest moving path. The partition wall members 48A, 48B and 48C have the upper part thereof communicated with the upper surface 32 between the introduction side cylinder 41 and the discharge side cylinder 45, and the lower part thereof separated from the bottom surface 36 by the distance A0 as shown in FIGS. 11 and 12.

Since the process for separating the bubble-like waste liquid into gas and liquid by the separation promoting member 40 shown in FIGS. 11 and 12 is the same as that by the structure 40 shown in FIGS. 9 and 10, explanation is not given here.

As heretofore mentioned, since the present invention is an air-liquid separating chamber, wherein a promotion separating member comprises an introduction side cylinder having slits, with the upper part communicated with the air-liquid introducing inlet port and the lower part separated from the bottom surface with a gap, and a discharge side cylinder having slits, with the upper part communicated with the gas discharging outlet port and the lower part separated from the bottom surface, air-liquid separation function can be pursued inside and outside the cylinders. Therefore, air-liquid separation can be executed with a high efficiency as well as a simple configuration and a small size can be achieved.

Moreover, according to the present invention, since the slits or the holes of the introduction side cylinder and the slits or the holes of the discharge side cylinder are formed so as not to face with each other, the flowing path can be longer and the chance of the clash in the cylinders can be increased, and thus the air-liquid separation can be executed with a further high efficiency.

Furthermore, according to the present invention, since a plurality of partition members are provided with the upper part interlocked with the upper surface between the introduction side cylinder and the discharge side cylinder and the lower part in the state separated from the lower surface so as to form a maze, the air-liquid separation function can further be promoted in the maze, and thus the air-liquid separation can be executed further completely.

Moreover, according to the present invention, since the lower surface of the main body is inclined downward toward the liquid discharging outlet, the liquid after separation can be discharged smoothly and completely, and thus re-scattering of the liquid can be prevented. That is, the air-liquid separation can be executed further efficiently.

Furthermore, according to the present invention, since the discharge side lower surface facing to the discharge side cylinder is disposed at a position higher than the introduction side lower surface facing to the introduction side cylinder, and the discharge side lower surface is inclined downward toward the introduction side lower surface, the liquid contained in the gas discharged from the gas discharging outlet can be eliminated completely.

Moreover, since the present invention is an ink jet printer comprising the above-mentioned air-liquid separating chamber, capable of collecting a waste ink separated from the air-liquid mixture discharged from an ink jet nozzle, maintenance of the ink jet nozzle can be executed smoothly and highly efficiently as well as since the waste ink cannot be scattered to the surroundings, leakage of the ink onto a paper sheet, or the like, can be prevented.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An air-liquid separating chamber comprising:

a lid part, an air-liquid introducing port provided in the lid part, for introducing an air-liquid mixture, an air discharging port provided in the lid part, for discharging a gas separated from the mixture, a container part to be closed by the lid part, having a bottom surface and a side surface for defining a cavity therein, a liquid discharging port provided on the bottom surface of the container part, communicating with the cavity for discharging a liquid separated from the mixture, a first cylindrical member disposed in the cavity, having one end and the other end, provided with a large number of slits or holes, with one end fixed to the lid member and communicating with air-liquid introducing port, and the other end facing to the bottom surface of the container part with a gap, a second cylindrical member disposed in the cavity, having one end and the other end, provided with a large number of slits or holes, with one end fixed to the lid member and communicating with the air discharging port, and the other end facing to the bottom surface of the container part with a gap, and partition plates disposed between the first and second cylindrical members in the cavity for defining the path for guiding a mixture and a gas flowing form the first cylindrical member to the second cylindrical member.

2. An air-liquid separating chamber according to claim 1, wherein the large number of the slits or the holes of the first cylindrical member are so arranged as to oppose to the large number of the slits or the holes of the second cylindrical member.

3. An air-liquid separating chamber according to claim 1, wherein the bottom surface of the container is inclined downward toward the liquid discharging port.

4. An air-liquid separating chamber according to claim 1, wherein the bottom surface of the container is sectioned into a first bottom surface part facing with the other end part of the first cylindrical member, and a second bottom surface part facing with the other end part of the second cylindrical member such that the first and second bottom surface parts are inclined downward toward the liquid discharging port, the second bottom surface part is connected with the first bottom surface part with a step, and the distance between the second bottom surface part and the lid part is smaller than the distance between the first bottom surface part and the lid part.

5. An ink jet printer comprising:

a nozzle head comprising a large number of nozzles for jetting an ink, means for receiving and holding the ink jetted from the nozzle having a gas mixed therein due to jetting, an air-liquid separating chamber for separating the ink mixture having the gas mixed therein, supplied from the receiving means into a gas and a liquid ink, including:

a lid part, an air-liquid introducing port provided in the lid part for introducing an air-liquid mixture, an air discharging port provided in the lid part for discharging a gas separated from the mixture, a container part to be closed by the lid part, having a bottom surface and a side surface for defining a cavity therein, a liquid discharging port provided on the bottom surface of the lid part, communicating with the cavity for discharging a liquid separated from the mixture, a first cylindrical member disposed in the cavity, having one end and the other end, provided with a large number of slits or holes, with one end fixed to the lid member and communicating with the air discharging port, and the other end facing to the bottom surface of the container part with a gap, a second cylindrical member disposed in the cavity, having one end and the other end, provided with a large number of slits or holes, with one end fixed to the lid member and communicating with the air discharging port, and the other end facing to the bottom surface of the container part with a gap, and partition plates disposed between the first and second cylindrical members in the cavity for defining the path for guiding a mixture and a gas flowing form the first cylindrical member to the second cylindrical member.

6. An ink jet printer according to claim 5, wherein the large number of the slits or the holes of the first cylindrical member are so arranged as to oppose to the large number of the slits or the holes of the second cylindrical member.

7. An ink jet printer according to claim 5, wherein the bottom surface of the container is inclined downward toward the liquid discharging port.

8. An ink jet printer according to claim 5, wherein the bottom surface of the container is sectioned into a first bottom surface part facing with the other end part of the first cylindrical member, and a second bottom surface part facing with the other end part of the second cylindrical member such that the first and second bottom surface parts are inclined downward toward the liquid discharging port, the second bottom surface part is connected with the first bottom surface part with a step, and the distance between the second bottom surface part and the lid part is smaller than the distance between the first bottom surface part and the lid part.

* * * * *